US009464851B2

(12) United States Patent
Provenziani

(10) Patent No.: US 9,464,851 B2
(45) Date of Patent: Oct. 11, 2016

(54) HEAT EXCHANGER

(75) Inventor: Franco Provenziani, Latina (IT)

(73) Assignee: PROVIDES METALMECCANICA S.R.L., Latina (IT)

( * ) Notice: Subject to any disclaimer, the term of this patent is extended or adjusted under 35 U.S.C. 154(b) by 688 days.

(21) Appl. No.: 13/992,035

(22) PCT Filed: Dec. 9, 2010

(86) PCT No.: PCT/IT2010/000491
§ 371 (c)(1),
(2), (4) Date: Jun. 6, 2013

(87) PCT Pub. No.: WO2012/077143
PCT Pub. Date: Jun. 14, 2012

(65) Prior Publication Data
US 2013/0277013 A1 Oct. 24, 2013

(51) Int. Cl.
*F28D 21/00* (2006.01)
*F28F 1/00* (2006.01)
*F25B 39/02* (2006.01)
(Continued)

(52) U.S. Cl.
CPC ..... *F28F 1/00* (2013.01); *F25B 39/02* (2013.01); *F28D 7/0066* (2013.01); *F28D 7/0075* (2013.01); *F28D 21/0017* (2013.01); *F25B 2339/0242* (2013.01); *F28D 7/16* (2013.01); *F28D 2021/0071* (2013.01); *F28F 2280/02* (2013.01)

(58) Field of Classification Search
CPC ..... F28F 9/0241; F28F 1/00; F28F 2280/02; F28D 7/06; F28D 7/0066; F28D 7/0075; F28D 7/0083; F28D 7/0091; F28D 21/0017; F28D 7/16; F28D 2021/0071; F28B 39/02; F25B 2339/0242
USPC ..... 165/157, 158, 140
See application file for complete search history.

(56) References Cited

U.S. PATENT DOCUMENTS 686,313 A * 11/1901 Mann ..... F28D 1/0435 165/140
2,091,757 A * 8/1937 Hanny ..... F24D 3/082 165/110
(Continued)

FOREIGN PATENT DOCUMENTS

DE 1950289 A1 * 4/1971 ..... F28D 7/0066
EP 1464384 10/2004
(Continued)

OTHER PUBLICATIONS

PCT International Search Report mailed on Dec. 5, 2011 for PCT Application PCT/IT2010/000491 filed on Dec. 9, 2010 in the name of Provides Metalmeccanica S.R.L.
(Continued)

*Primary Examiner* — Tho V Duong
(74) *Attorney, Agent, or Firm* — Steinfl & Bruno, LLP

(57) ABSTRACT

A flooded heat exchanger of is described. The flooded heat exchanger has a primary tube bundle inside which a first operating fluid flows, a skirt surrounding the primary tube bundle and receiving a second operating fluid which flows over the primary tube bundle, and one or more extractable units, each in turn having a secondary tube bundle which receives an auxiliary operating fluid, and a secondary tube plate for performing a removable connection to the flooded heat exchanger.

10 Claims, 2 Drawing Sheets

(51) Int. Cl.
*F28D 7/00* (2006.01)
*F28D 7/16* (2006.01)

(56) References Cited

U.S. PATENT DOCUMENTS 2,819,882 A * 1/1958 Stephani ..... F22D 1/32 165/140
4,502,530 A * 3/1985 Huenniger ..... F28F 9/0219 165/158
5,836,382 A 11/1998 Dingle et al.
5,845,703 A * 12/1998 Nir ..... F22B 3/04 122/7 R
6,206,086 B1 * 3/2001 McKey ..... F28D 7/1646 165/158
6,276,442 B1 * 8/2001 Rasmussen ..... F28B 1/02 165/110
2003/0131977 A1 * 7/2003 West ..... F28D 7/1676 165/159
2009/0178790 A1 7/2009 Schreiber et al.
2010/0132927 A1 6/2010 Benetton et al.

FOREIGN PATENT DOCUMENTS

GB 556382 A * 10/1943 ..... F25B 39/02
GB 560060 3/1944
WO 2006/083250 8/2006

OTHER PUBLICATIONS

PCT Written Opinion mailed on Dec. 5, 2011 for PCT Application PCT/IT2010/000491 filed on Dec. 9, 2010 in the name of Provides Metalmeccanica S.R.L.
PCT International Preliminary Report on Patentability with reply to the IPRP mailed on Nov. 23, 2012 for PCT Application PCT/IT2010/000491 filed on Dec. 9, 2010 in the name of Provides Metalmeccanica S.R.L.

* cited by examiner

HEAT EXCHANGER

CROSS REFERENCE TO RELATED APPLICATIONS

The present application is the US national stage of International Patent Application PCT/IT2010/000491 filed on Dec. 9, 2010.

The present invention relates to a heat exchanger, in particular suitable for use in industrial air-conditioning plants, and to a unit associated therewith.

A very common type of heat exchanger for industrial use is a so-called flooded heat exchanger.

As is well known to the person skilled in the art, this type of exchanger has a skirt which acts as an outer casing and which contains one or more tube bundles inside which a first operating fluid, in particular a "hot" fluid, flows. A second "cold" operating fluid, i.e. a refrigerating fluid, is then supplied inside the skirt and flows over the tube bundle or bundles so as to ensure heat exchange with the first fluid.

According to the most common operating modes, at the end of the exchange is stage, the second fluid should be completely vaporized. However, a drawback which is frequently encountered is that the second operating fluid contains residual atomized particles (mostly due to low superheating of the vapour) which may damage the components downstream of the exchanger or in any case result in their operation under non-standard conditions.

Moreover, a general drawback of the known systems consists in their poor versatility in response to changes in the fluid temperature and flowrate requirements downstream.

Therefore the technical problem posed and solved by the present invention is that of providing a heat exchanger and an associated extractable unit which are able to overcome the drawbacks mentioned above with reference to the prior art.

This problem is solved by an extractable unit and by a heat exchanger.

The invention also relates to an operating method for heat exchange.

Preferred features of the present invention are defined in the dependent claims thereof.

The present invention provides a number of significant advantages. The main advantage consists in the fact that the extractable unit according to the invention, by means of an associated secondary tube bundle, allows further superheating of the refrigerating operating fluid, thereby eliminating any atomized liquid particles present in the flow thereof.

Moreover, since this unit according to the invention is removable, maintenance may be carried out easily.

Further advantages, characteristic features and the modes of use of the present invention will become clear from the following detailed description of a number of preferred embodiments thereof, provided by way of a non-limiting example. Reference shall be made to the figures in the accompanying drawings in which.

Figure 1:
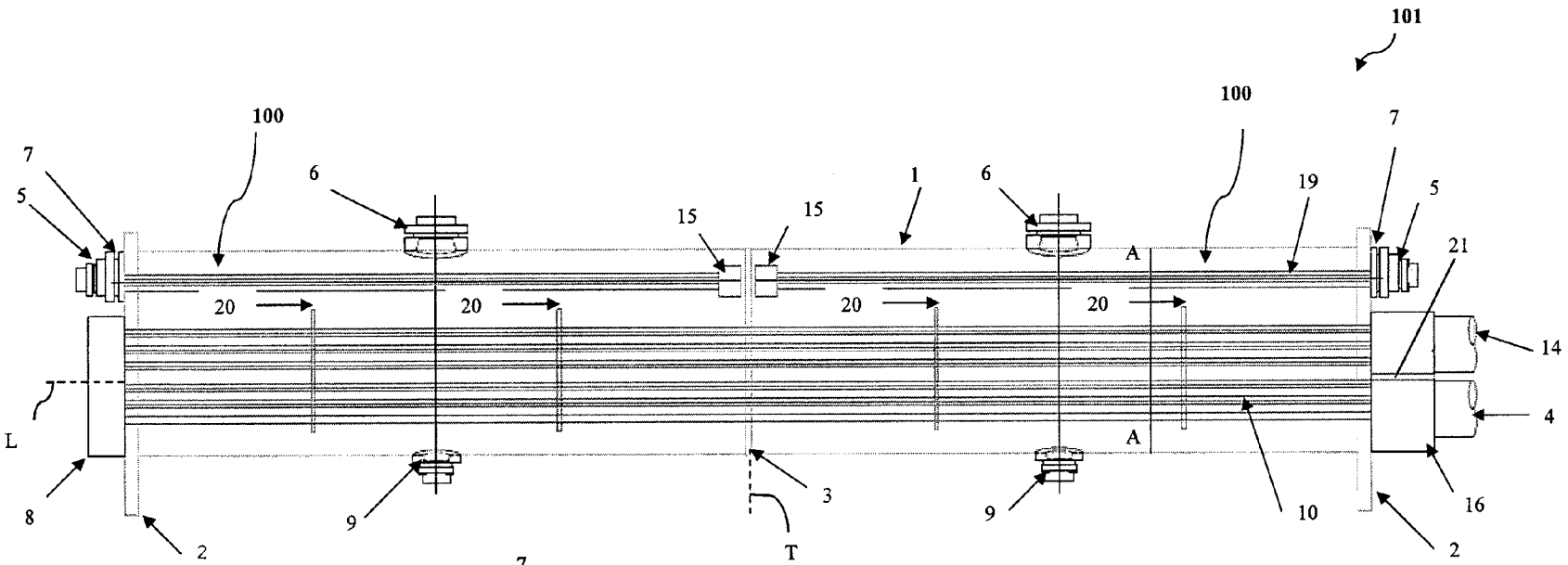
FIG. 1 shows a schematic side view of a heat exchanger according to a first preferred embodiment of the present invention.
Figure 1A:
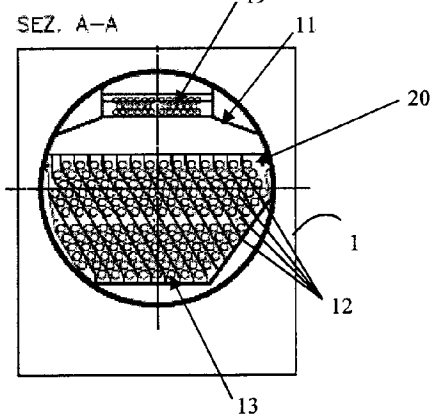
FIG. 1A shows a cross-sectional view of the exchanger according to FIG. 1, along the line A-A thereof.
Figure 1B:
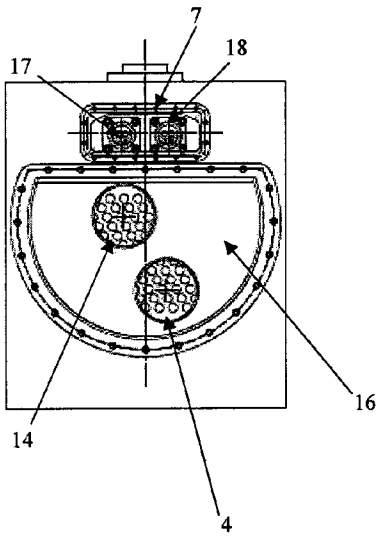
FIG. 1B shows a schematic front view of the exchanger according to FIG. 1.

With reference initially to FIGS. 1, 1A and 1B, a heat exchanger according to a preferred embodiment of the invention is denoted overall by 101.

The heat exchanger 101 is shown with a pair of extractable exchanger units mounted thereon, each being denoted by 100 and being designed according to a preferred embodiment of the invention.

The exchanger 101 is of the so-called flooded type and includes a skirt 1 which acts as an outer casing and which has a typical oblong form defined by a longitudinal axis of symmetry L and by a transverse axis of symmetry T.

One or more primary tubes 10 are housed inside the skirt 1 and have, flowing inside them, a first operating fluid, in particular a "hot" fluid. This first operating fluid is supplied inside the primary tube bundle 10 of the exchanger 101 via an inlet 4 and flows out of via an outlet 14 arranged on the same—front—side of the skirt 1 as the inlet 4. The inlet and the outlet 4 and 14 may be in the form of connectors or nozzles of the type known per se. In the present embodiment, said first operating fluid is water. Applicational variants may envisage the use of water with anti-freeze or other fluids.

The tubes of the primary bundle 10 therefore pass longitudinally through the space inside the skirt 1 along a serpentine path, with at least one outgoing section and at least one return section. Along this serpentine path, the tubes of the primary bundle 10 are supported by membranes or baffles 20 and by a middle tube plate 3 which extends transversely inside the skirt 1, from one side to the other thereof, and is permanently fastened to it for example by means of welding. Two further tube plates 2 are provided at the front and rear outer walls of the skirt 1 and are also permanently fastened to the latter for example by means of welding.

The tubes of the primary bundle 10 are permanently connected, and in particular for example drifted, inside special holes in the bundle plates 2 and 3.

At the rear wall of the skirt 1, i.e. on the opposite side to the inlet 4 and outlet 14, a header or end closing member 8 is arranged on the outside of the respective tube plate 2 and fastened to it. The header 8 collects the water from the bottom part of the serpentine path of the primary tube bundle 10 and supplies the top part thereof.

At the front wall of the skirt 1, in this case also a similar end closing member 16 is arranged on the outside of the respective tube plate 2 and fastened to it. This front end member 16 has a sealed internal partition 21 which divides the incoming operating fluid supplied by the connector 4 from the outgoing fluid conveyed to the connector 14.

A second "cold" operating fluid, i.e. a refrigerating fluid, in liquid form or almost completely liquid form, is then supplied inside the skirt 1, via a pair of bottom inlets 9. This operating fluid floods the skirt 1, flowing over the primary tube bundle 10 so as to ensure heat exchange with the first operating fluid, and is then recalled into a special pair of outlet/intake nozzles 6, now being in gaseous form. The latter are arranged on top of the skirt 1—i.e. on the opposite side to the bottom inlets 9—and each on a respective side of the middle tube plate 3. The inlets 9 and the outlets 6 may also be in the form of connectors or nozzles of the type known per se.

Relative to the flow of the second operating fluid, the middle tube plate 3 forms a series partition for the exchange of heat between the first and second fluids, therefore defining two exchange circuits which, as implied, are arranged in series.

The exchanger 101 considered here is therefore of the so-called double-circuit type (skirt side) or "double pass" type (tube inner side). In different embodiment which envisage only one "pass", the inlet and outlet for the first fluid are situated on opposite sides. One such variant also envisages other modifications in the arrangement of the components within the competence of a person skilled in the art.

Moreover, further constructional variants with three or more passes (tube side) or three or more circuits (skirt side) may also be envisaged.

As can be seen more clearly in FIG. 1A, inside the skirt 1 the flow of the second operating fluid is guided by distribution means. In the present example, these comprise advantageously a longitudinal distributor in the form of a perforated plate 13, in particular a sheet-metal plate, permanently fastened in a sealed manner, for example by means of welding, to the skirt itself 1 and arranged underneath the primary tube bundle 10.

Further transverse distribution elements are associated with the longitudinal distribution plate 13 that, in the present example, consist of baffles or partitions 12 which are fixed to the skirt 1 and extend over the entire height of the primary tube bundle 10, transversely alongside the latter.

The inclination of the transverse baffles 12 corresponds to a transversely staggered arrangement of the tubes of the primary bundle 10 and has the effect that the gas bubbles resulting from vaporization of the second operating fluid following heat exchange with the tube bundle 10 do not have a direct impact on the rows of transversely adjacent tubes of the primary tube bundle 10, thus favouring the exchange efficiency since the bubbles occupy space, therefore removing space from the liquid, resulting in inefficiency during exchange. Moreover, with the above-mentioned arrangement a convective flow which improves the exchange is created.

As mentioned above, a pair of extractable units 100, which in the present example act as superheaters of the second operating fluid, is associated with the exchanger 101 as described hitherto. In particular, a first extractable unit 100 is inserted via the rear wall of the skirt 1 and a second extractable unit 100 is inserted via the front wall of the skirt 1, so that there is an extractable unit for each of the two exchange circuits separated by the middle tube plate 3.

For the sake of simplicity, the description which follows will be provided with reference to only one of said units 100, the comments being applicable also to the other unit on the opposite side.

The extractable unit 100 is removably connected to the exchanger 101 at a top portion of the respective front or rear tube plate 2, for example by means of bolts or similar mechanical means. A fixing plate or flange 7, which acts both as a tube plate for the unit 100 and as a means for performing mounting on the exchanger 101, is provided for the purposes of this connection.

The fixing plate 7 has a mechanical seal between it and the associated tube plate 2 which prevents any loss of refrigerant (skirt side).

Different embodiment may envisage means for removable connection of extractable unit 100 and exchanger 101 different from those considered here.

The extractable unit 100 comprises a secondary tube bundle 19 which is passed through during operation by an auxiliary operating fluid, in the application described here a "hot" fluid, in particular a liquid refrigerant supplied by a condensing plant. This secondary tube bundle 19 follows a serpentine path, with at least one outward section and at least one return section, the length of which is defined by the distance between the respective front or rear tube plate 2 and the middle tube plate 3 of the exchanger 101.

In the already mentioned exchanger variant with a single circuit, this length would be defined by the distance between the two front and rear tube plates.

The extractable unit 100 therefore has an inlet and outlet 17 and 18 which are arranged alongside each other on the same front or rear wall of the skirt 1, these also being in the form of connecters or nozzles which are known per se. On the opposite side to the latter, a header or end closing member 15 sealing with a seal is provided, said header being required for the return of the auxiliary fluid inside the tubes of the secondary bundle 19 after the outward section.

Owing to the arrangement described the unit 100 may be introduced into and connected to the exchanger 101 in a simple and rapid manner, acting on only one side (front or rear) of the latter.

Preferably, the tubes of the secondary tube bundle 19 are of the finned type.

Fixed to the skirt 1, above the primary tube bundle 10—i.e. downstream of the heat exchange between the latter and the secondary operating fluid—the exchanger 101 has means for channelling the flow of secondary fluid towards the tube bundle 19 of the extractable unit 100. These channelling means, in the present example, are in the form of two lateral deflectors 11 which are fixed to the skirt 1 and designed in the form of inclined lateral plates extending over the entire longitudinal length of the skirt 1.

In this way, the secondary operating fluid, which rises after flowing over the primary tube bundle 10 and is in the form of a wet refrigerating gas in the present application, along its path towards the outlets 6 is "channelled" by the deflectors 11 towards the secondary tube bundle 19. Along this path where the secondary operating fluid flows over the tube bundle 19, the hot liquid inside the latter cools and the wet secondary gas is heated more than the heat exchange with the primary tube bundle 10. This allows a compressor arranged downstream of the exchanger 101 to draw off, via the intake connector 6, "dry" superheated gas, thus ensuring the total absence of liquid droplets in the gas itself.

At the same time, the auxiliary operating fluid, which is typically in the liquid state, is subcooled and flows out of the outlet 18. Preferably, this outflowing operating fluid is introduced again into the exchange stage through one of the inlets 9, usually via an expansion/regulating valve which keeps the liquid level inside the skirt 1 at the desired level, entering below the primary tube bundle 10 in the form of a "cold" secondary operating fluid. This type of connection between the outlet 18 for the auxiliary operating fluid flowing into the extractable unit 100 and the inlet 9 for the secondary operating fluid may also be of the removable type.

The entire length of the deflectors 11 is also provided with a guide for inserting the extractable unit 100, which also acts as a support for the unit 100 itself.

From the above description it can be understood how the extractable unit 100 forms a removable exchanger designed to provide a secondary heat exchange stage.

Figure 2:
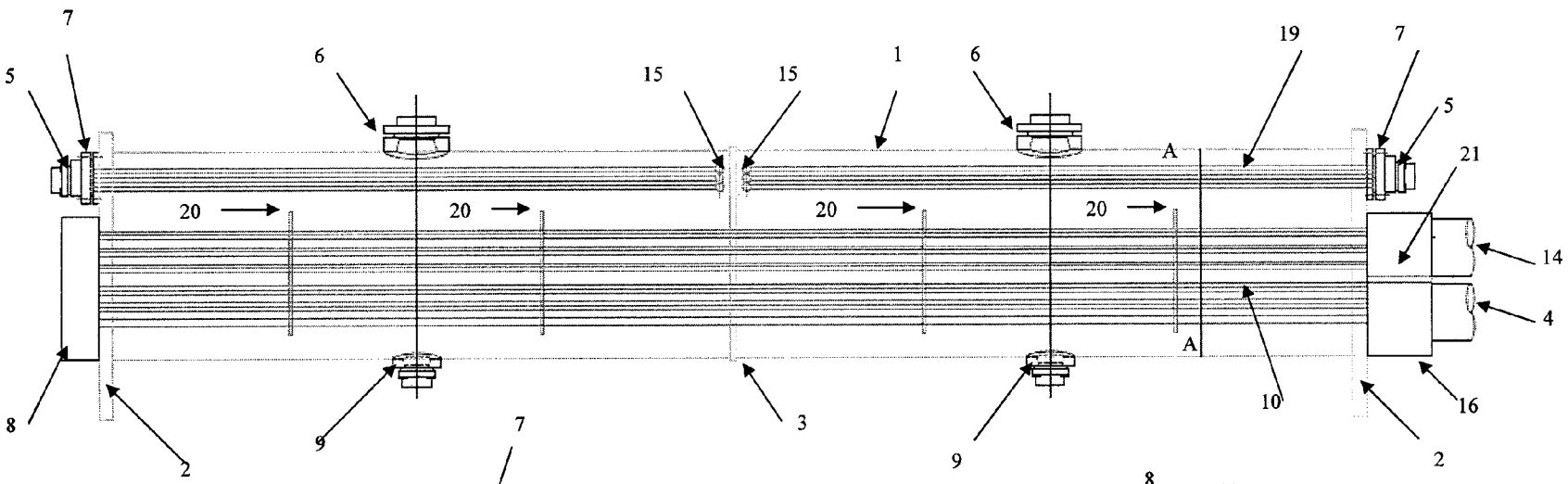
FIG. 2 shows a schematic side view of a heat exchanger according to a second preferred embodiment of the present invention.
Figure 2A:
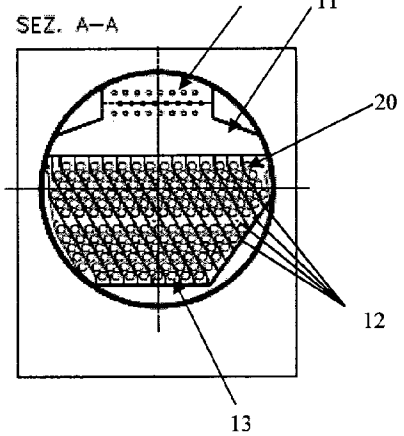
FIG. 2A shows a cross-sectional view of the exchanger according to FIG. 2, along the line A-A thereof.
Figure 2B:
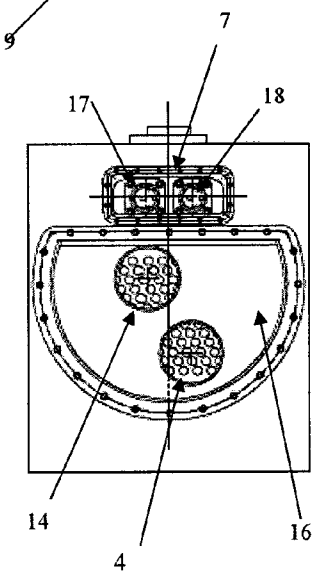
FIG. 2B shows a schematic front view of the exchanger according to FIG. 2.

A second embodiment of the invention is shown in FIGS. 2, 2A and 2B which employ the same reference numbers already used, for components which the same or similar to those of the first embodiment.

Compared to the first embodiment already described, in the second embodiment the configuration of the tubes of the secondary bundle 19 of the extractable unit 100 is different, since these tubes, which are also finned, have a so-called "battery" arrangement which is well-known to the person skilled in the art. This means that the end closing member 15 is in fact formed by various headers which are typically composed of copper/steel tubes. In a preferred embodiment, the tubes of the extractable unit are smooth or grooved, in battery form with so-called packed lamellae.

As already mentioned, in a variation of embodiment, the exchanger may have a single circuit instead of two circuits (without middle tube plate 3) and in this case it may in any case be associated with a pair of extractable units or with a single extractable unit.

It will be understood that in the description provided hitherto the use of relative terms, such as "front", "rear", "top" and "bottom", is to be understood as being purely exemplary and functional in nature for the purpose of ensuring greater descriptive clarity with reference to the drawings of the embodiments considered.

The present invention has been described hitherto with reference to preferred embodiments thereof. It is understood that other embodiments relating to the same inventive idea may exist, as defined by the scope of protection of the claims which are provided hereinbelow.

The invention claimed is:

1. A heat exchanger assembly, comprising:

i) a flooded heat exchanger, comprising:

ii) a primary tube bundle inside which, during use, a first operating fluid flows:

ii) a skirt surrounding said primary tube bundle and adapted to receive a second operating fluid which laps, during use, against said primary tube bundle;

iii) one or more extractable units adapted to be removably inserted inside said flooded heat exchanger, each extractable unit comprising:

a secondary tube bundle inside which, during use, an auxiliary operating fluid flows; and a first connector for removable connection of the extractable unit to the heat exchanger, said means first connector being adapted to allow insertion of said secondary tube bundle inside the skirt downstream of the primary tube bundle with respect to a flow of the second operating fluid, and iv) two lateral deflectors shaped as inclined lateral planes fixed to the skirt below one or more of said secondary tube bundles and extending along an entire longitudinal length of the skirt, the two lateral deflectors being configured to channel the second operating fluid towards the one or more of said secondary tube bundles and to act as a guide, along an entire length of the two lateral deflectors, for insertion of the one or more extractable units.

2. The heat exchanger assembly according to claim 1, wherein said secondary tube bundle extends in a serpentine path, with an outward section and a return section.

3. The heat exchanger assembly according to claim 2, wherein said one or more extractable units have an inlet and an outlet for the second operating fluid, which are arranged on a same side.

4. The heat exchanger assembly according to claim 1, wherein said first connector for the removable connection comprises a secondary tube plate.

5. The heat exchanger assembly according to claim 1, further comprising a second connector for removable fluid connection which is adapted to establish fluid communication between an auxiliary fluid outlet of said one or more extractable units and an inlet for the second operating fluid of the flooded heat exchanger.

6. The heat exchanger assembly according to claim 1, further comprising a distributor for distributing the second operating fluid inside said skirt.

7. The heat exchanger assembly according to claim 6, wherein said distributor is a longitudinal distributor arranged upstream of said primary tube bundle.

8. The heat exchanger assembly according to claim 7, wherein said longitudinal distributor comprises a perforated plate.

9. The heat exchanger assembly according to claim 6, wherein said distributor comprises one or more transverse distribution elements arranged alongside said primary tube bundle.

10. The heat exchanger assembly according to claim 9, wherein said one or more transverse distribution elements comprise inclined baffles or partitions.

* * * * *